US006061074A

United States Patent [19]

Bartha et al.

[11] Patent Number: 6,061,074

[45] Date of Patent: May 9, 2000

[54] ION GENERATOR FOR IONOGRAPHIC PRINT HEADS

[75] Inventors: Johann Bartha, Metelen; Frank Druschke, Stuttgart; Gerhard Elsner, Kaarst; Johann Greschner, Pliezhausen, all of Germany

[73] Assignee: International Business Machines Corporation, Armonk, N.Y.

[21] Appl. No.: 08/778,982

[22] Filed: Jan. 6, 1997

[30] Foreign Application Priority Data

Jan. 29, 1996 [DE] Germany ..... 196 03 043

[51] Int. Cl.[7] ..... B41J 2/415

[52] U.S. Cl. ..... 347/123; 347/125; 347/126; 347/137

[58] Field of Search ..... 347/125, 127, 347/123, 126; 399/135

[56] References Cited

U.S. PATENT DOCUMENTS 4,628,227 12/1986 Briere ..... 347/127
4,745,421 5/1988 McCallum et al. ..... 347/127
4,890,123 12/1989 McCallum et al. ..... 347/126
4,891,656 1/1990 Kubelik ..... 347/127
4,958,172 9/1990 McCallum et al. ..... 347/125
5,030,975 7/1991 McCallum et al. ..... 347/148
5,159,358 10/1992 Kubelik ..... 347/127

*Primary Examiner*—N. Le
*Assistant Examiner*—Hai C. Pham
*Attorney, Agent, or Firm*—Stephen S. Strunck

[57] ABSTRACT

An ion generator for the generation of a plasma is assembled from module subassemblies. The first subassembly includes a dielectric plate 1, on the first surface 1*a* of which are located a large number of first electrodes 3, and the second surface 1*b* of which is coated with a structured conductive layer 2. The second subassembly includes an aperatured spacer plate with a large number of dielectric spacers with a second electrode 5 on the side facing away from the dielectric plate 1. In joining the subassemblies together, the aperatured spacer plate is connected to the dielectric plate 1 at its first surface 1*a* in such a way that cavities 6 for accommodating plasma are formed by the first electrodes 3, parts of the first surface 1*a* of the dielectric plate 1 and the spacers 4 with the second electrodes 5. The first set of electrodes 3 shield the points where the subassemblies are bonded together from plasma in the cavities.

18 Claims, 4 Drawing Sheets

ION GENERATOR FOR IONOGRAPHIC PRINT HEADS

FIELD OF THE INVENTION

The invention relates to an ion generator, which can be used in an ionographic print head, and to a process for the manufacture of such an ion generator.

BACKGROUND OF THE INVENTION

An ionographic print head, as represented in FIG. 4, consists of a high-frequency wiring arrangement (HF) located on the top of a dielectric plate. This wiring arrangement must be matched to a hole structure present in the underside of the said dielectric plate in an initial electrode system, referred to as a finger electrode system. A further, second plane of electrodes, provided with a hole structure, referred to as a dot matrix electrode, is maintained at a distance of some 200 $\mu$m from the finger electrode system by means of a dielectric spacer, likewise provided with holes, or a separation layer. Due to the fact that the hole structures of the individual planes are aligned precisely above one another, a hole system is created beneath the dielectric plate of the HF wiring system, in which a plasma can be ignited by means of a coupled HF current. In the plasma there occur, inter alia, negative charges, which are accelerated by means of a more positive potential imposed at the dot matrix electrode. The accelerated charges penetrate the hole structure at the end of the dot matrix electrode (at the end of the acceleration path) impinge on a rotating drum, and are stored there. A latent point charging pattern pertains, which is then applied in the conventional manner by means of toner onto paper or plastic film and burned in, as described in U.S. Pat. No. 4,891,656.

The dielectric plate is usually made of Muscovite mica (potash mica, $H_2KAl_3(SiO_4)_3$) ; see U.S. Pat. No. 5,030,975; U.S. Pat. No. 4,628,227; U.S. Pat. No. 4,958,172; and is bonded with the HF electrodes on the basis of an epoxy adhesive capable of being hardened by UV radiation. In view of the fact that mica breaks very easily, mechanical shocks and the slightest flexure or rotation of this layer system is to be avoided. In instances in which flexure cannot be avoided, use must be made of a flexible dielectric plate. For instance, a silicone plastic can be used, which is capable of being hardened by UV radiation, and which can be applied in silk screen printing processes. In addition to the sensitivity to fracture of mica, the resistance to plasma discharge of both the mica and the silicone plastic used as an alternative, is low. As a result, the ionographic printing head only has a short service life. A plasma which is ignited in the atmosphere delivers, during ion production, ozone and nitric acid as byproducts, which corrode the mica; the silicone plastic used as an alternative is subject to erosion. Therefore, both are subject to damage caused by the plasma. A further disadvantage in the use of mica derives from the fact that it is only obtainable in small dimensions, with the result that only small-format print heads can be obtained.

The plane which follows the dielectric plate in the construction of the head is a perforated finger electrode system, usually made of stainless steel or molybdenum, which (see U.S. Pat. No. 5,030,975) as secured to the underside of the dielectric plate by means of an adhesive which hardens. The next plane to follow is a plane provided with slots, which serves as the spacer between the finger electrodes and the screening electrode system. This dielectric spacer, about 200 $\mu$m thick, consists either of UV-hardening plastic, which is applied by a silk screen printing process; or of photolithographic film, capable of texture structuring, such as VACREL from DuPont (see U.S. Pat. No. 4,745,421, and U.S. Pat. No. 4,890,123). Finally, the dot matrix electrode, likewise provided with a hole structure, is bonded to the spacer element by means of a silicone adhesive. The superimposed hole/slot/hole structures of dot matrix electrode/spacer/finger electrode define a system of small hollow cavities with a volume of about $6\times10^6$ $\mu m^3$, in which a plasma can be ignited via a wiring arrangement located above the cavities.

To date, the ionographic printing technique has not yet succeeded in achieving an economic breakthrough because of two basic problems; namely, short service life and excessive fluctuations of the charge stored per image element, have stood in the way of the advance of this technique. The excessively short service life is, as already mentioned, attributable to the plasma erosion of the polymers used. The second basic problem, the severe fluctuation of the charge stored per image element, can be attributed to the excessive deviation in the layer thicknesses (mica, spacers, adhesive layers, etc.) and the orientation of the HF wiring to the plasma cavity. In addition to this, the dimensions of the many small plasma cavities are also subject to considerable fluctuation, caused by the manufacturing technique (screen printing, lamination, etc.).

In order to counteract the plasma erosion, the mica layer has been replaced in the past by glass, ceramics, or glass ceramics. However, the high sintering temperature which occurs during the manufacture of the layer has proved to be an impediment to such replacements; see U.S. Pat. No. 4,958,172. Likewise, the use of porcelain-coated steel sheets has again been rejected because of their uneven surface.

The second basic problem is the lack of sufficient grey tone gradation, caused by the sharp charge fluctuations between the individual image dots. For coloured or black-white quality prints on paper or plastic film, at least 64 grey gradations are required.

From this is derived a maximum charge fluctuation of $\Delta Q$=approx. 5%. This requirement in turn demands the finest possible manufacturing tolerances in fabricating the printing head. Based on $\Delta Q \leqq 5\%$, a value of $\pm 2$ $\mu$m is derived for the displacement (see FIG. 3) between the HF wiring plane and the finger electrode plane, while a value of $\pm 23$ $\mu$m is permissible for the displacement between the finger electrode plane and the dot matrix electrode plane. Likewise, the thickness tolerance of the dielectric spacer may only amount to $\Delta d \pm 2$ $\mu$m. For the diameter deviation of the holes in the finger electrode, a value is permitted of $\pm 2.6$ $\mu$m for a hole diameter of 125 $\mu$m, and for the dot matrix electrode a deviation of $\pm 1$ $\mu$m for a hole diameter of 163 $\mu$m.

Therefore, an object of this invention is to create a precisely made ion generator with a longer service life.

BRIEF DESCRIPTION OF THE INVENTION

In accordance with the present invention, a micromechanical method is used in the manufacture of the ion generator to obtain the degree of precision required. The micromechanical method of manufacture uses micromechanically processable materials, which are not sensitive to the plasma or to the erosion caused by it to increase service life. FIG. 3 shows a position tolerance of $\pm 2$ $\mu$m between the high-frequency electrodes and the finger electrodes. This position tolerance is achieved using micromechanical manufacturing methods that allow for position tolerances of $\pm 1$ $\mu$m to be achieved. The ion generator is made in modular fashion of two separate components formed using semiconductor fabrication processes which modules are then bonded together. If adhesive bonding points are used, those points are positioned so that they are shielded by electrodes from direct plasma contact.

BRIEF DESCRIPTION OF THE DRAWINGS

An embodiment of the invention is now described making reference to the accompanying drawings of which.

DETAILED DESCRIPTION OF THE DRAWINGS

Figure 1:
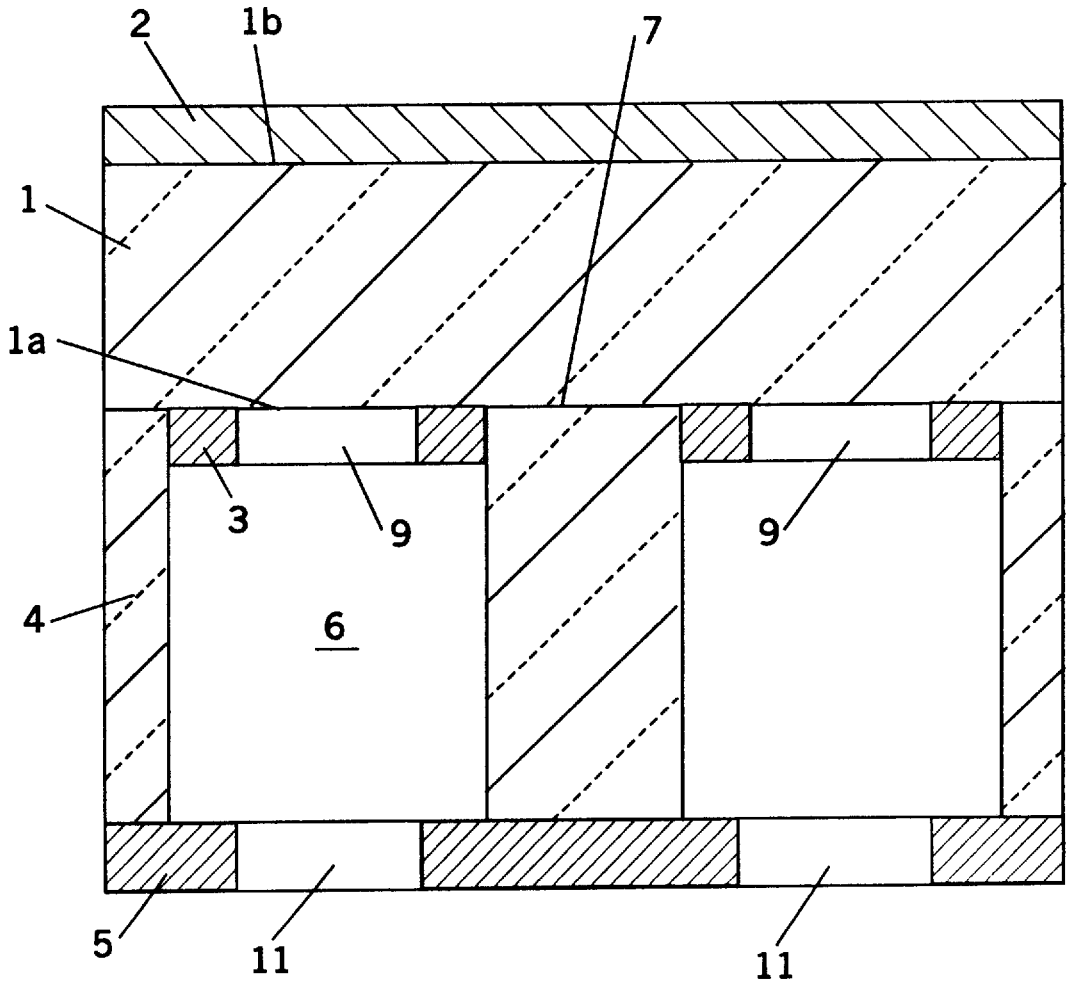
FIG. 1 is a schematic cross-sectional illustration of the ion generator according to the invention taken along line 1—1 in FIG. 4.
Figure 4:
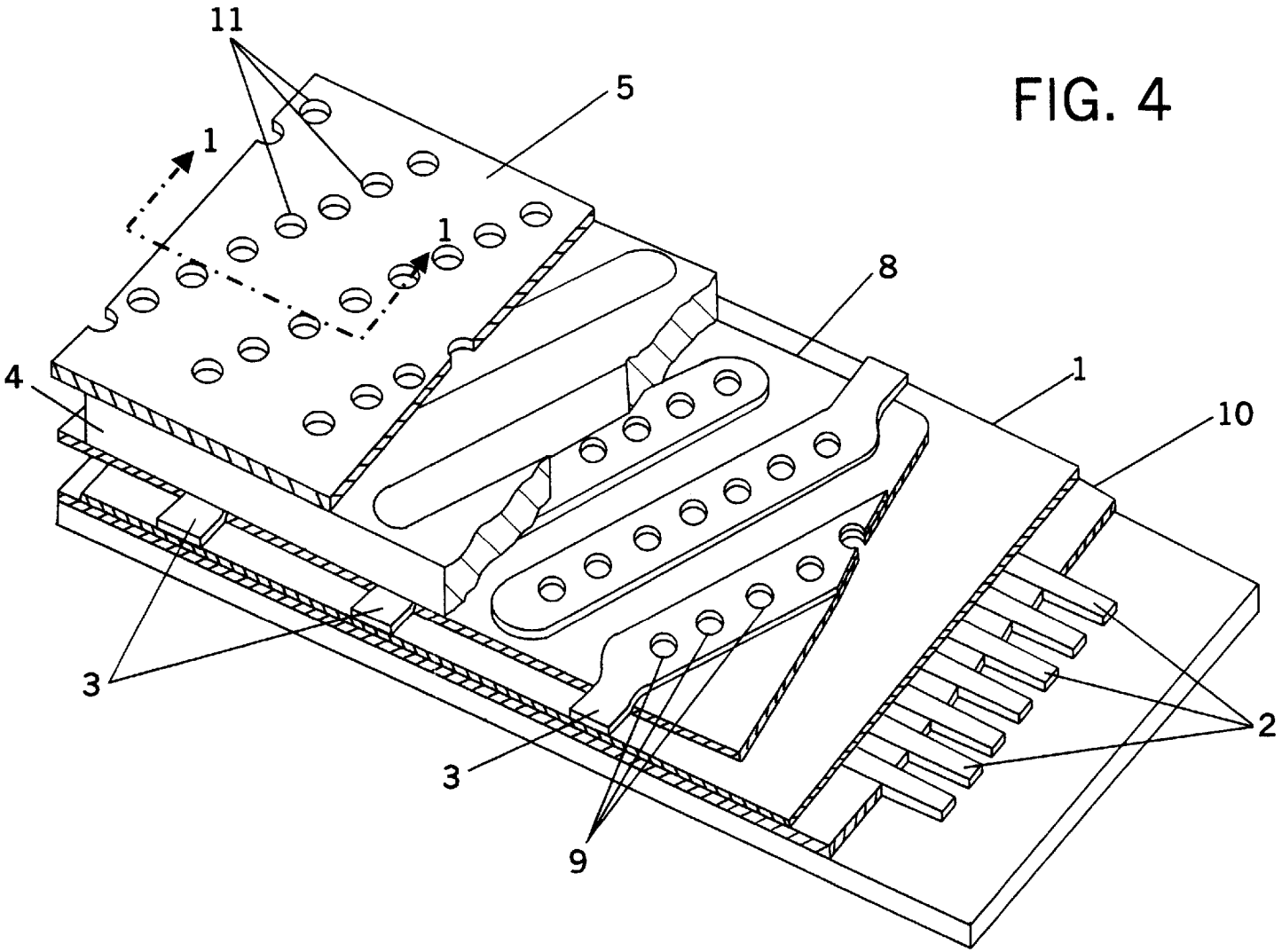
FIG. 4 shows a perspective view of an ionographic print head on a base plate in which, to render the composition more clearly, a number of layers such as the dielectric plate or the electrode planes have been broken away. Again, the reference numbers of FIG. 1 are used here to indicate structure performing the same function.

Referring now to FIGS. 1 and 4, the ion generator includes a dielectric plate 1. The dielectric plate is made of a mechanically stable material, which as far as possible features a high dielectric constant $\epsilon_r$. This allows for the use of plates with a greater thickness d, since the capacitance is $C-\epsilon_r/d$. Particularly well-suited for this purpose is a plate made of $Al_2O_3$, polished on both sides, with a thickness of approximately 35 $\mu$m.

Other appropriate materials with high dielectric constants are, for example, SiC with a dielectric constant $\epsilon_r$=40, or barium titanate and other ferroelectric substances which feature dilelectric constant values up to 1200. Another well-suited material is a mixture of $Al_2O_3$ and TiC, which is also used in the manufacture of magnetic heads.

As an alternative to the materials already referred to, a low cost dielectric composite material that improves the service life of the ion generator would be suitable. For instance, a polymer, such as polyamide, laminated on both sides with copper, with a spun glass layer on the side which faces the plasma, and which has been heated to a temperature suitable to the particular polymer, will fulfill all the demands placed on the dielectric plate 1. Another alternative is a siliconized light-sensitive lacquer. Both the spin-on glass and the siliconized light-sensitive lacquer increase the service life considerably, especially in air or oxygen plasmas, since $SiO_2$ forms in situ.

Located on a first surface 1*a* of the plate 1 are a large number of initial electrodes 3, and the second surface 1*b* of the plate 1 is covered with a structured conductive layer 2.

Attached to the first surface 1*a* of the plate 1 is a plate spacer plate 4 having a number of cavities therein with shapes that conform to the electrodes 3. On the side of the spacer plate 4 facing away from the dielectric plate is an electrode plate 5 with a number of openings therein. A preferred material for the spacers 4 is silicon and the electrodes 3 and 5 are made of metals such as Cu, Ni, or Mo.

The spacer plate 4 is connected to the first surface 1*a* of the dielectric plate 1 in such a way that the sidewalls of the cavities 6 for accommodating the plasma to be generated are formed of the first electrodes 3 and parts of the first surface 1*a* of the dielectric plate 1, the spacer plate 4 and the electrode plate 5.

Figure 2A:
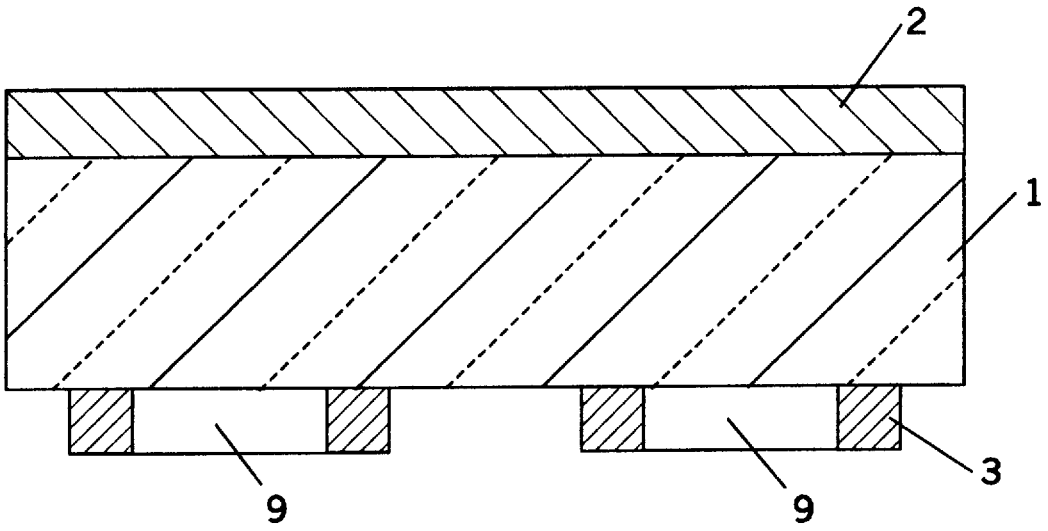
FIGS. 2*a* and 2*b* are schematic cross-sectional illustrations each of one of the modules from which the ion generator is assembled.
Figure 2B:
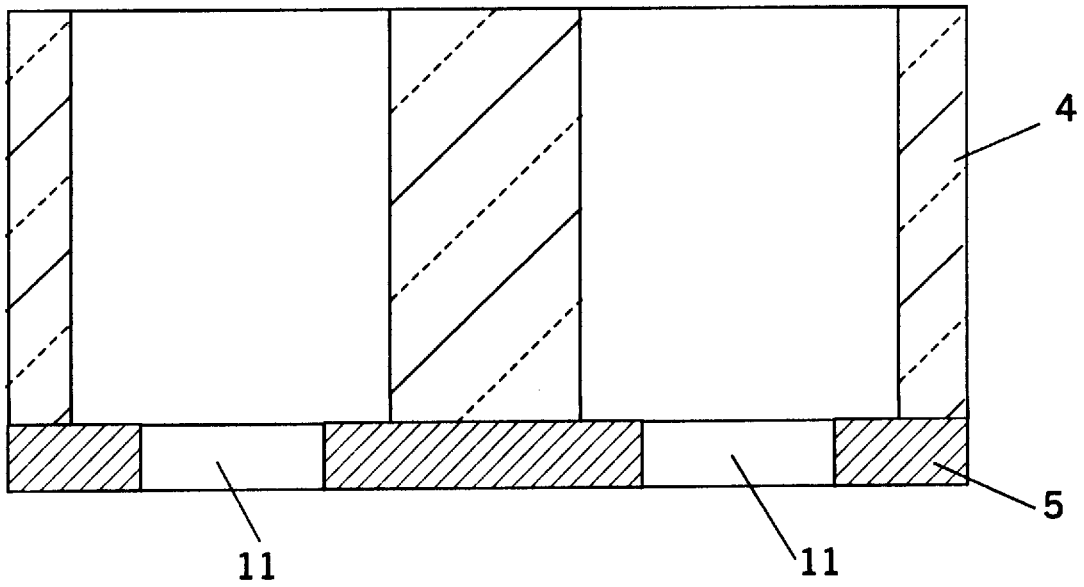
Figure 3:
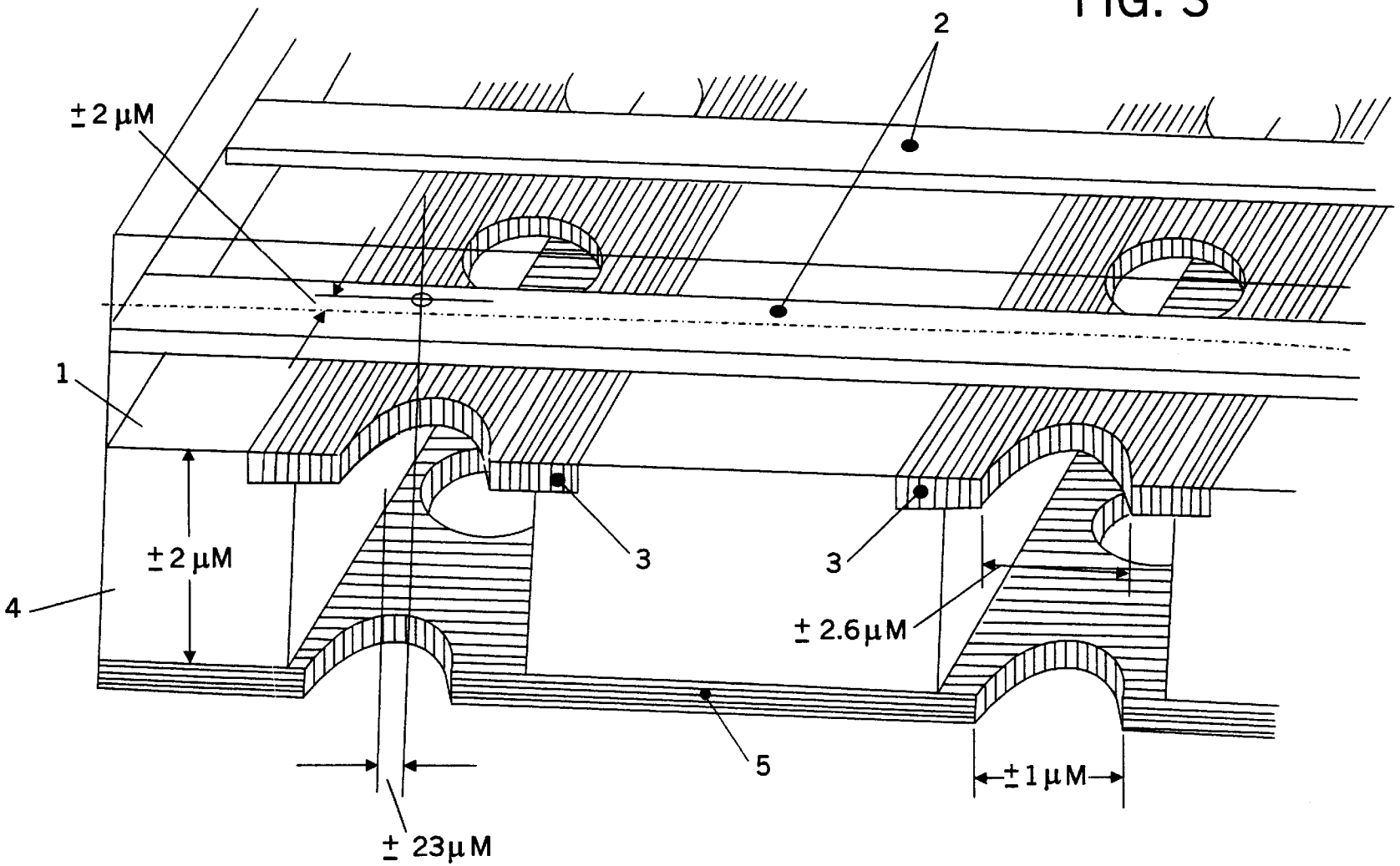
FIG. 3 is a schematic three-dimensional representation of a state of the art ion generator, in which the reference markings in FIG. 1 are used for structures that perform the same function.

The dielectric plate 1 and the dielectric spacer plate 4 are fabricated in modular format, as shown in FIG. 2*a* and FIG. 2*b,* and are then connected to one another by means of adhesive bonding points. The adhesive used is the only organic substance in the entire structure. Thanks to the structure of the ion generator, however, these adhesive points 7 are shielded by the first electrodes 3 in such a way that they do not come in contact with the plasma forming in the cavities 6.

On a first surface 1*a* of a dielectric, mechanically stable plate 1, made of one of the materials already indicated, initial electrodes 3 are formed. On the second surface 1*b* a conductive layer 2 is applied, which is still to be structured.

To do this, a thin layer of Cr/Cu is applied on both sides of the plate, preferably by sputter application. The thickness of the Cr/Cu is appropriately in the range of approximately 2 $\mu$m. Subsequently the plate is coated thickly on both sides with light-sensitive lacquer, in which context the thickness of the lacquer layer is in the range from 50 to 100 $\mu$m.

By using the suitable mask for the particular plate side concerned, the light-sensitive lacquer layers 8 and 10 are exposed to light and then developed, thus simultaneously creating the patterns for the structured conductive layer 2, (the HF wiring) and for the first electrodes 3 with holes 9 therethrough, (referred to as finger electrodes) with a position tolerance in the light-sensitive lacquer of ±1 $\mu$m.

After developing, the areas opened in the lacquer layer 8 on the first surface side 1*b* are filled with metal, such as Cu or Ni. A suitable process for this is, for example, the electroplating process. This plating process through the light-sensitive lacquer mask ensures a high degree of dimensional precision, and always for the edges of the first or finger electrodes 3 created by the plating to be used for joining the two modules. The edges of the electrodes 3 fit snuggly in the cavities in the spacer plate 4.

The spacer plate 4 is made from a disk, preferably a silicon disk with plane-parallel sides, with a (110) orientation. A variation in plane parallelity of less than 1 $\mu$m can be achieved polishing Si,. One side of the disk is coated over its entire surface with $SiO_2$; the other side with a metal, such as Mo. Subsequently a light-sensitive lacquer is applied on both the $SiO_2$ and metal layers, and exposed to light thru use of the mask to produce the appropriate pattern of holes 11. After developing the light-sensitive lacquer, the $SiO_2$ layer is used as a mask to etch the cavities into the spacer plate 4. This is done by using an anisotropic wet-etching step, with, for example, a KOH solution. The $SiO_2$ layer is then removed after the etching step.

On the other side, the light-sensitive structure is applied to the metal layer. A wet-etching process is also suitable for this. This accordingly establishes the apparatus in the second electrode 5.

The spacer plates 4 are now connected to the dielectric plate 1 in such a way that the second electrodes 5 are located on the side of the spacers 4 which face away from the dielectric plate 1. The first electrodes 3, parts of the first surface 1*a* of the dielectric plate 1, and the spacers 4, now form the cavities 6 for accommodating the plasma thus created.

When the modules are joined, the edges of the first or finger electrodes 3, serve abut against the sidewalls in the cavities of the dielectric spacer plate 4.

The modules can be adhesively bonded together with an organic adhesive between the plates 1 and 4 which adhesive is shielded from the plasma in the cavity 6 by the electrodes 3. If metal oxides are used for the dielectric plate 1, the adhesive bonding process can be replaced by a thermal bonding step, without using any organic material (which is particularly susceptible to the threat of plasma erosion).

While the invention has been described with respect to the illustrated embodiment, it will be understood by those skilled in the art that various changes can be made without departing from the spirit, scope and teaching of the invention.

We claim:

1. An ion generator for the generation of a plasma which is manufactured by micromechanical processes, comprising:

a) a first module having a dielectric plate with a first set of metal electrodes with an exposed surface upstanding from a first surface of the dielectric plate so that the electrodes form raised islands with trenches therebetween defined by the first surface being the floor of the trenches and sidewalls of the electrodes extending away from the first surface to the exposed surface of the conductive electrodes being the sides of the trenches;

b) a second separate module having:

i) a second set of conductive electrodes;

ii) a spacer plate positioned between the first surface and the second set of conductive electrodes with open passages through the spacer plate over the first set of electrodes to form cavities for accommodating plasma, an end of the spacer plate facing the dielectric plate and having end portions in the trenches with end surfaces of the end portions, facing the dielectric plate, bonded to the first surface and sections of sidewalls of the open passages abutted against the sidewalls of the electrodes of the first set that extend away from the first surface; and c) a bonding agent between said end surfaces and said first surface at points isolated from the cavities by the juncture of the abutted sidewalls of the first electrodes and the sections of the sidewalls of the open passages to isolate the bonding agent from plasma in the cavities.

2. An ion generator according to claim 1 wherein the dielectric plate is made of a mechanically stable material with a high dielectric constant.

3. An ion generator according to claim 2 wherein the dielectric plate is made from one or more of the materials from a group including $Al_2O_3$, SiC, barium titanate, ferroelectrics, mixtures of $Al_2O_3$ and TiC, and siliconized light-sensitive lacquer.

4. An ion generator according to claim 1 including a set of conductive lines on a second surface of the dielectric plate which lines are centered over apertures in said first set of electrodes.

5. An ion generator of claim 4 wherein said spacer plate is silicon, and the first and second sets of electrodes are one or more metals from a group including Cu, Ni, and Mo.

6. The ion generator of claim 1 wherein the passages are wider adjacent first set of conductive electrodes having a ledge that fits against the top surfaces of those electrodes.

7. The ion generator of claim 1 wherein said bonding agent is an organic adhesive.

8. The ion generator according to claim 7 wherein the ion generator is made entirely of non-organic materials except for the organic adhesive.

9. The ion generator according to one of claim 8 wherein said cavities are in an ionographic print head in an ionographic printer.

10. The ion generator according to claim 1 wherein said first set of conductive electrodes have an underlying bonding layer bonded to the first surface and made of one or more of the metals from the group consisting of Cu, Cr, Ni and Mo.

11. The ion generator according to claim 10, wherein said spacer plate is silicon with said passages etched holes therethrough and said end surfaces comprising a silicon dioxide layer thereon.

12. The ion generator of claim 11 wherein said first set of conductive electrodes includes a first sputtered metal underplay adhered directly to the first side and a plate of exposed metal layer thereon.

13. The ion generator of claim 12 wherein the second set of conductive electrodes comprise a metal coating adhered directly to the surface of the dielectric spacer plate, said metal coat having etched holes positioned over the first set of conductive electrodes.

14. The ion generation of claim 13 wherein the first and second sets of conductive electrodes are one or more layers of metals from the group consisting of Cu, Cr, Ni and Mo.

15. The ion generator of claim 14 including a set of etched conductive lines on the second surface of the dielectric plate.

16. The ion generator of claim 1 wherein said first set of metal electrodes have a metal bonding layer fixing the electrode to the first surface.

17. The ion generator of claim 16 wherein said bonding agent is an organic adhesive.

18. The ion generator of claim 17 wherein said metal bonding layer is one or more metals from the group consisting of Cu, Cr, Ni and Mo.

* * * * *